US009486391B2

(12) United States Patent
Shemesh

(10) Patent No.: US 9,486,391 B2
(45) Date of Patent: Nov. 8, 2016

(54) MULTIPLE VIAL DRUG MIXING SYSTEM

(75) Inventor: Eli Shemesh, Ashdod (IL)

(73) Assignee: Teva Medical Ltd., Ashdod (IL)

( * ) Notice: Subject to any disclaimer, the term of this patent is extended or adjusted under 35 U.S.C. 154(b) by 881 days.

(21) Appl. No.: 13/390,939

(22) PCT Filed: Aug. 22, 2010

(86) PCT No.: PCT/US2010/046256

§ 371 (c)(1),
(2), (4) Date: Jul. 11, 2013

(87) PCT Pub. No.: WO2011/025719

PCT Pub. Date: Mar. 3, 2011

(65) Prior Publication Data

US 2014/0102552 A1 Apr. 17, 2014

(30) Foreign Application Priority Data

Aug. 23, 2009 (IL) ..... 200547

(51) Int. Cl.

| | |
|---|---|
| ***A61J 1/20*** | (2006.01) |
| ***A61J 1/14*** | (2006.01) |
| *A61J 1/10* | (2006.01) |

(52) U.S. Cl.

CPC ..... *A61J 1/20* (2013.01); *A61J 1/1475* (2013.01); *A61J 1/2089* (2013.01); *A61J 1/10* (2013.01); *A61J 1/201* (2015.05); *A61J 1/2034* (2015.05); *A61J 1/2051* (2015.05); *A61J 1/2058* (2015.05); *A61J 1/2075* (2015.05); *A61J 1/2082* (2015.05); *Y10T 137/598* (2015.04)

(58) Field of Classification Search

CPC ..... A61J 1/10; A61J 1/1425; A61J 1/20; A61J 1/2051; A61J 1/2075; A61J 1/2082

See application file for complete search history.

(56) References Cited

U.S. PATENT DOCUMENTS

| | | | | |
|---|---|---|---|---|
| 6,106,509 | A | 8/2000 | Loubser | |
| 2004/0073189 | A1* | 4/2004 | Wyatt | A61M 5/162 604/411 |
| 2009/0054834 | A1* | 2/2009 | Zinger | A61J 1/2089 604/84 |

FOREIGN PATENT DOCUMENTS

| | | |
|---|---|---|
| WO | 95/07720 | 3/1995 |
| WO | 95/16490 | 6/1995 |
| WO | 2005/120431 | 12/2005 |
| WO | 2008/126090 | 10/2008 |

* cited by examiner

*Primary Examiner* — Philip R Wiest
*Assistant Examiner* — Kai Weng
(74) *Attorney, Agent, or Firm* — Dekel Patent Ltd.; David Klein

(57) ABSTRACT

A vial adapter modular assembly (10) including a bag spike port (12) connectable to an output port (16) of a bag (18), a vial port (20) connectable to a vial, and an exit port (24), characterized by a lumen (32) having a vial port flow opening (36) in fluid communication with the vial port (20), and a plunger element (34) that slides in the lumen (32) between a non-blocking position and a blocking position, wherein in the non-blocking position, the plunger element (34) does not block the vial port flow opening (36) and permits fluid flow between the bag spike port (12) and the vial port (20), and wherein in the blocking position, the plunger element (34) blocks the vial port flow opening (36) and blocks fluid flow between the bag spike port (12) and the vial port (20).

7 Claims, 6 Drawing Sheets

MULTIPLE VIAL DRUG MIXING SYSTEM

FIELD OF THE INVENTION

The present invention relates to drug mixing systems generally and particularly to a system for multiple connection of vials for mixing multi-part drugs.

BACKGROUND OF THE INVENTION

Drug mixing systems are well known in the art. One particular drug mixing system is described in published PCT patent application WO 2005/041846, assigned to the current assignee of the present application, the disclosure of which is incorporated herein by reference. The drug mixing system is commercially available from Teva Medical Ltd. and is sold under the brand name Tevadaptor. It is a system for safe compounding and administration of hazardous intravenous drugs. Tevadaptor minimizes the risk of exposure to hazardous drug substances, and eliminates the risk of needle stick injuries. The drug mixing system is intended for use with a luer fitted hypodermic syringe.

The Tevadaptor drug mixing system includes a receptacle port adapter that can be inserted into a port of a fluid receptacle, such as an IV bag. A vial adapter element is provided for connection to a vial containing a drug. A syringe adapter element can be attached to a syringe and to the receptacle port adapter and/or the vial adapter element.

The syringe adapter element has a needle that fluidly communicates with the contents of the syringe. The needle does not normally protrude outwards, but rather is sealed inside the syringe adapter element by a septum. The syringe adapter element can be screwed onto the luer lock tip of the syringe, which brings the needle of the syringe adapter element into fluid communication with the contents of the syringe.

Similarly, the vial adapter element has a spike that fluidly communicates with the contents of the vial, and is sealed by a septum. The vial can be pushed onto the vial adapter element, wherein the spike of the vial adapter element punctures the septum of the vial. The vial adapter element may then be pushed onto the syringe adapter element, wherein the needle of the syringe adapter element punctures the septa of the syringe adapter element and the vial adapter assembly. This allows fluid to flow from the syringe through the needle of the syringe adapter element and through the spike of the vial adapter element to the vial.

After filling the vial with a desired amount of fluid, the vial adapter assembly may be separated from the syringe adapter element. Immediately upon separation, the needle of the syringe adapter element retracts inwards and is sealed by elastomeric septa. In this manner, no fluid drips outwards.

SUMMARY OF THE INVENTION

The present invention seeks to provide further features to a drug mixing system, particularly a system for multiple connections of vials for mixing multi-part drugs, as is described further in detail hereinbelow.

There is thus provided in accordance with an embodiment of the present invention a vial adapter modular assembly including a bag spike port connectable to an output port of a bag, a vial port connectable to a vial, an exit port, a vent element, a lumen having a vial port flow opening and a vent port flow opening formed therein, the vial port flow opening being in fluid communication with the vial port and the vent port flow opening being in fluid communication with the vent element, and a plunger that slides in the lumen between a non-blocking position and a blocking position, wherein in the non-blocking position, the plunger element does not block the vial port flow opening and permits fluid flow between the bag spike port and the vial port, and wherein in the blocking position, the plunger element blocks the vial port flow opening and blocks fluid flow between the bag spike port and the vial port.

The term "bag" encompasses not only a bag, but any kind of suitable container for mixing substances and/or infusion sets.

In accordance with an embodiment of the present invention the plunger is formed with a hollow portion and apertures are formed at a distal end of the plunger, wherein fluid is flowable through the hollow portion and the apertures.

In accordance with an embodiment of the present invention the vent element includes a filter.

In accordance with an embodiment of the present invention the vent element is positioned along the lumen at a junction of the bag spike port, the vial port and the exit port. Alternatively, the vent element can be positioned at the bag spike port, the vial port and/or the exit port or even at or on the cap.

In accordance with an embodiment of the present invention there are at least two vial adapter modular assemblies, referred to as first and second vial adapter modular assemblies, wherein the bag spike port of the second vial adapter modular assembly is inserted into the exit port of the first vial adapter modular assembly.

In accordance with an embodiment of the present invention inserting the bag spike port of the second vial adapter modular assembly into the exit port of the first vial adapter modular assembly pushes the plunger element of the first vial adapter modular assembly along the lumen to the blocking position in the first vial adapter modular assembly.

There is also provided in accordance with an embodiment of the present invention a vial adapter modular assembly including a bag spike port connectable to an output port of a bag, a vial port connectable to a vial, an exit port, a lumen having a vial port flow opening in fluid communication with said vial port, and a closure element that has a non-blocking position and a blocking position, wherein in the non-blocking position, said closure element does not block said vial port flow opening and permits fluid flow between said bag spike port and said vial port, and wherein in the blocking position, said closure element blocks said vial port flow opening and blocks fluid flow between said bag spike port and said vial port. The closure element may be a clamp that selectively closes and opens a flow conduit that leads to the vial port.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1:
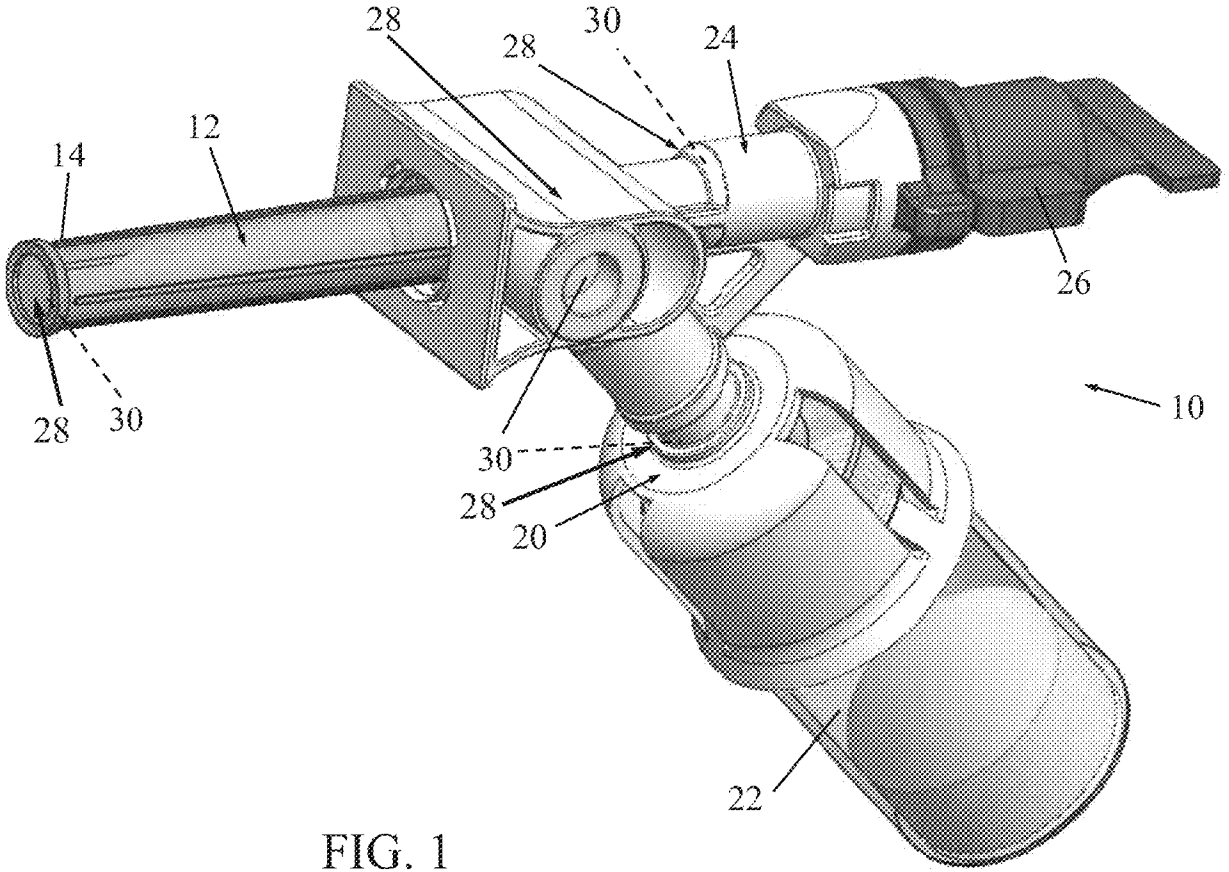
FIG. 1 is a pictorial illustration of a vial adapter modular assembly for a drug mixing system, constructed and operative in accordance with an embodiment of the present invention, for serial connection to another vial adapter modular assembly, and showing a vial connected to a vial port, a bag spike port closed with a cap, an exit port closed with a cap, and a vent element that has a filter.
Figure 2:
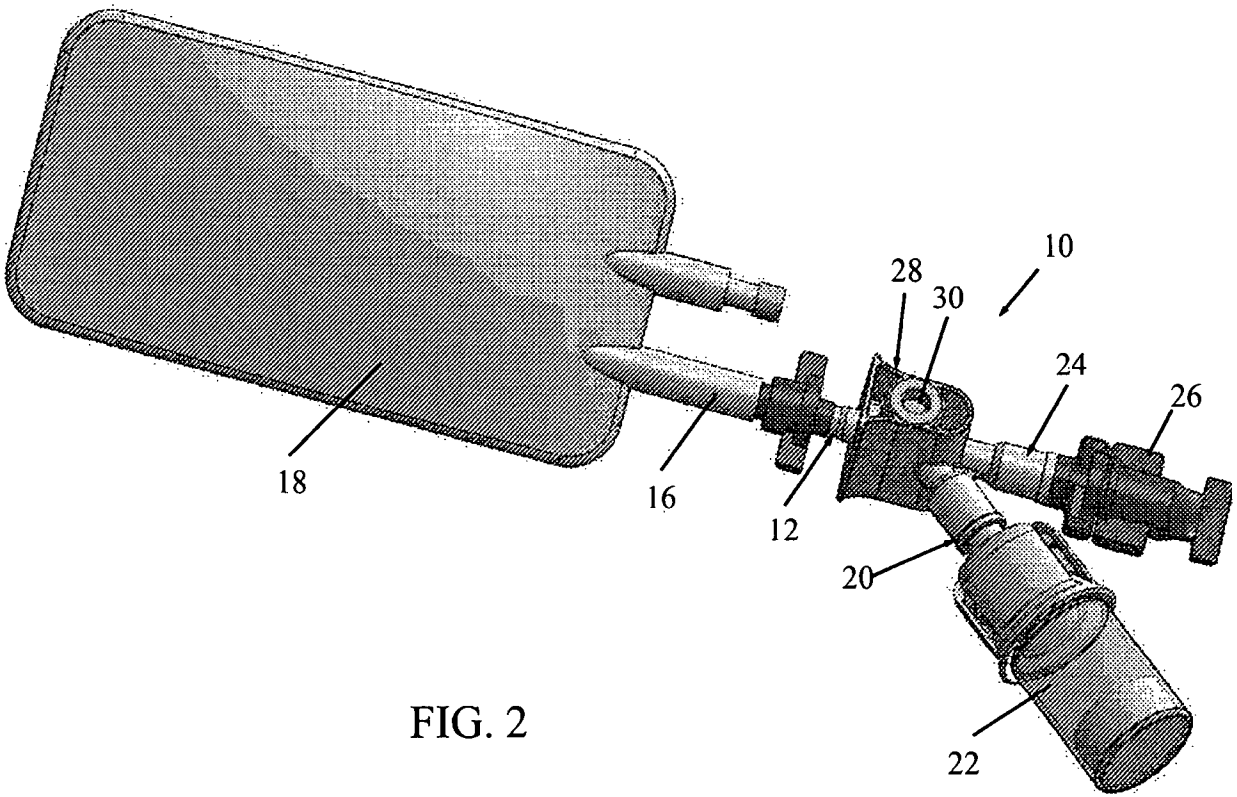
FIG. 2 is a pictorial illustration of the vial adapter modular assembly of FIG. 1 connected to the output port of a bag, in accordance with an embodiment of the present invention.

Reference is now made to FIGS. 1 and 2, which illustrate a vial adapter modular assembly 10 for a drug mixing system, constructed and operative in accordance with an embodiment of the present invention.

Vial adapter modular assembly 10 includes a bag spike port 12, which in FIG. 1 is closed with a cap 14. As seen in FIG. 2, bag spike port 12 may be connected to an output port 16 of a bag 18 (which may contain a mixing liquid). The connection may be effected by the spike (or needle) of bag spike port 12 piercing a septum (not shown) of output port 16 of bag 18. Cap 14 is of course removed before connecting to the bag.

Vial adapter modular assembly 10 also includes a vial port 20 to which one connects a vial 22. Again, the connection may be effected by a needle or spike of vial port 20 piercing a septum (not shown) of vial 22. Vial adapter modular assembly 10 also includes an exit port 24 closed with a cap 26. Vial adapter modular assembly 10 is preferably vented, such as by a vent element 28 that has a filter 30. Vent element 28 is shown in FIGS. 1 and 2 positioned along a lumen 32 (seen in FIGS. 4-5) at a junction of bag spike port 12, vial port 20 and exit port 24. Alternatively, vent element 28 may be placed elsewhere, such as at the end of one of the ports (e.g., the end of the bag spike port 12 or cap 14, as shown in dotted line in FIG. 1 or along another place on lumen 32).

Figure 3:
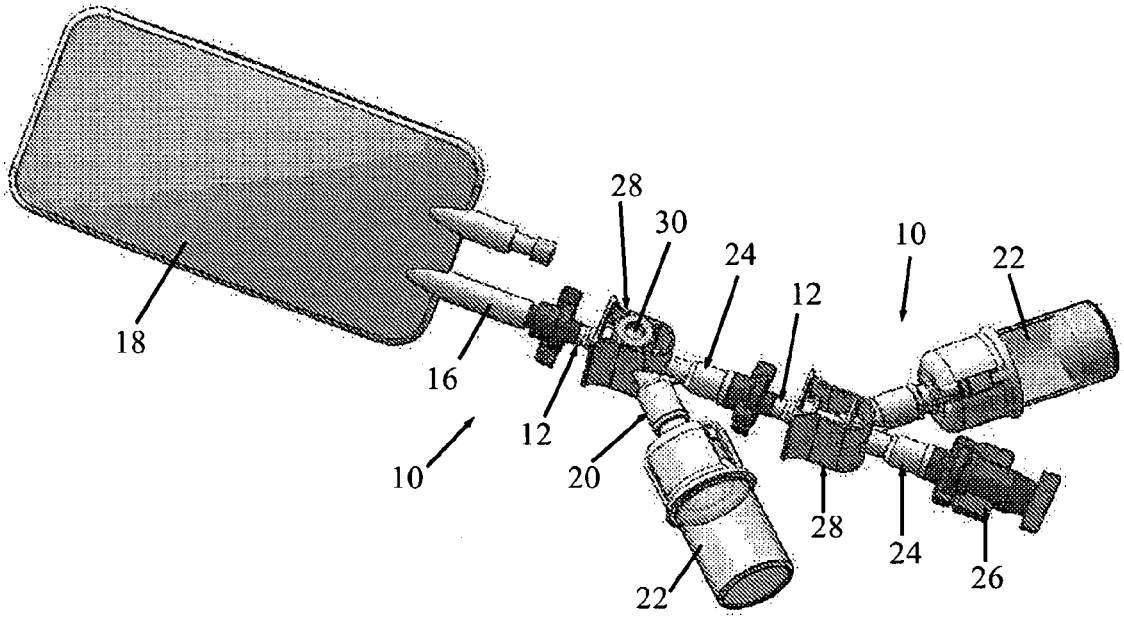
FIG. 3 is a pictorial illustration of a second vial adapter modular assembly connected to the vial adapter modular assembly of FIG. 1, in accordance with an embodiment of the present invention, and showing a vial connected to a vial port of the second vial adapter modular assembly.

Vial adapter modular assembly 10 can be used for serial connection to another vial adapter modular assembly. This is shown in FIG. 3, which illustrates a second vial adapter modular assembly 10 (the one on the right in the drawing) connected to the first vial adapter modular assembly 10 (the one on the left in the drawing). Cap 26 of the first vial adapter modular assembly 10 has been removed and the bag spike port 12 of the second vial adapter modular assembly 10 has been inserted into the exit port 24 of the first vial adapter modular assembly 10.

Vial adapter modular assembly 10 selectively seals or allows flow between the bag 18 and the first and second vials 22, as is now explained.

Figure 4:
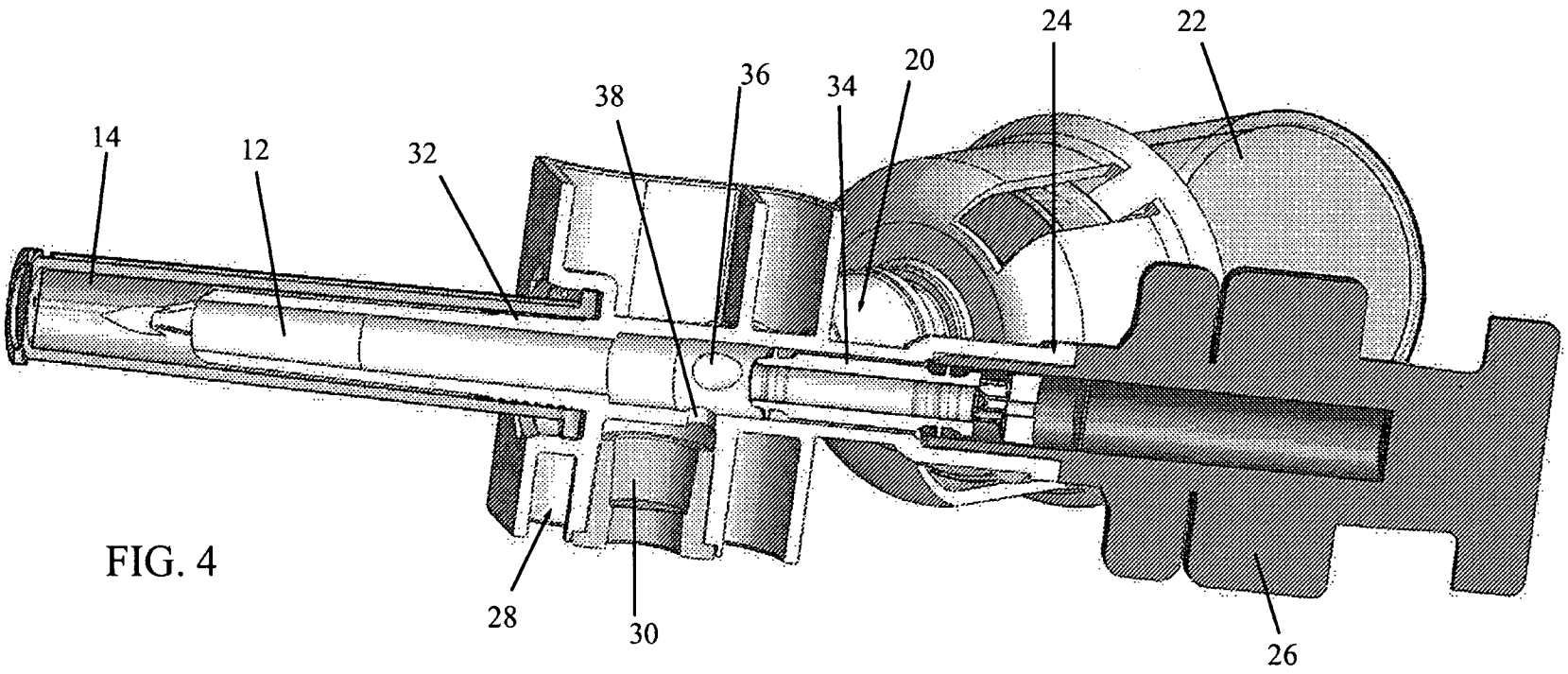
FIG. 4 is a simplified partially cutaway illustration of the vial adapter modular assembly of FIG. 1, showing a plunger element in a position that permits fluid flow to the vial port and to the vent element, in accordance with an embodiment of the present invention.

Reference is now made to FIG. 4. The vial adapter modular assembly 10 includes a plunger element 34 that slides in lumen 32. Plunger element 34 may be constructed of a flexible material, such as an elastomeric material, or any other material suitable for sealing and sliding. Lumen 32 is the flow channel between the various ports of vial adapter modular assembly 10. Lumen 32 has a vial port flow opening 36 and a vent port flow opening 38 formed therein. Vial port flow opening 36 is in fluid communication with vial port 20. Vent port flow opening 38 is in fluid communication with vent element 28.

FIG. 4 shows plunger element 34 in a position closer to exit port 24. In this position, plunger element 34 does not block vial port flow opening 36 and 38 and permits fluid flow between bag spike port 12 (and thus bag 18, not shown in FIG. 4) and vial port 20 (and thus vial 22). Accordingly, in this position, liquid in bag 18 may be mixed and shaken together with the contents of vial 22 to form a solution, which may be stored temporarily in bag 18 (vial 22 being now empty). Fluid communication to vent element 28 is open so no air is trapped that could possibly interfere with the fluid flow between bag 18 and vial 22. Vent element 28 ensures equilibrium of fluid pressures for proper flow.

Figure 5:
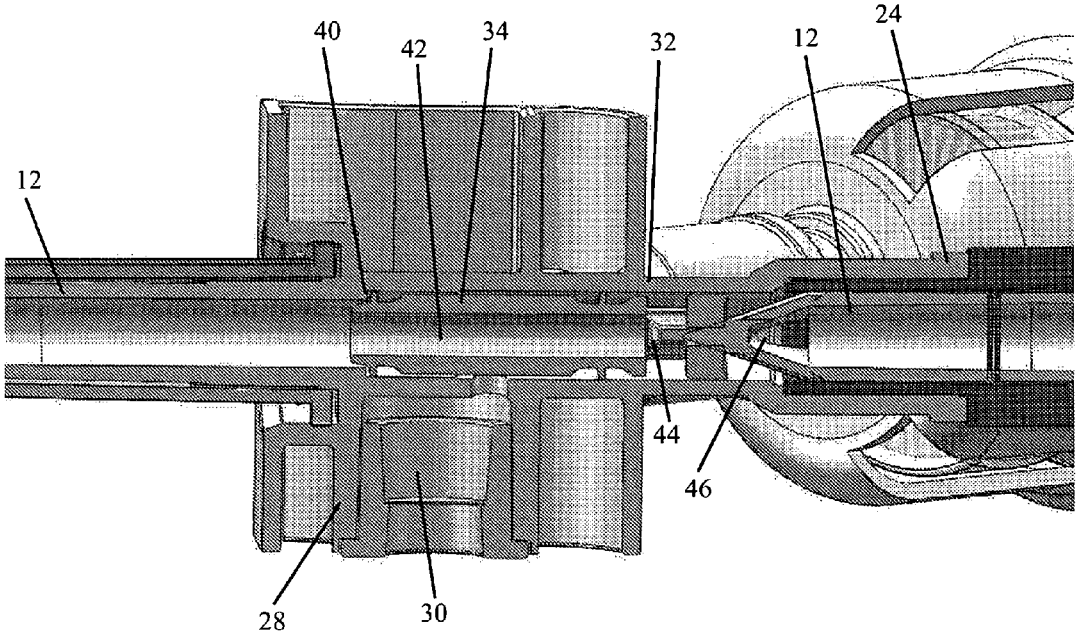
FIG. 5 is a simplified partially cutaway illustration of the vial adapter modular assembly of FIG. 1, wherein the plunger element has been moved to a position that blocks fluid flow to the vial port and to a vent element, and fluid flow is only permitted through a needle along a longitudinal lumen of the vial adapter modular assembly towards the exit port of the vial adapter modular assembly.

FIG. 5 shows the configuration of FIG. 3, namely, FIG. 3, the second vial adapter modular assembly has been connected to the first vial adapter modular assembly. The cap of the first vial adapter modular assembly has been twisted off or otherwise removed and the bag spike port 12 of the second vial adapter modular assembly has been inserted into the exit port 24 of the first vial adapter modular assembly. The action of inserting bag spike port 12 of the second vial adapter modular assembly into the exit port 24 of the first vial adapter modular assembly pushes the plunger element 34 of the first vial adapter modular assembly along lumen 32 towards the bag spike port 12 of the first vial adapter modular assembly (towards the left in the sense of the drawing). Plunger 34 preferably abuts against a stop 40 formed in lumen 32, thereby arresting further movement of plunger 34 in lumen 32. In this position, plunger element 34 blocks vial port flow opening 36 and vent port flow opening 38. Now fluid cannot flow between bag 18 and the first vial 22. Instead fluid can flow between bag 18 and the second vial 22 (FIG. 3). Fluid flows from bag 18 through a hollow portion 42 of plunger 34 out through apertures 44 formed at a distal end of plunger 34, then through apertures 46 formed in a proximal end of the bag spike port 12 of the second vial adapter modular assembly. Fluid can continue to flow in this position to the second vial (not shown) because the plunger of the second vial adapter modular assembly is in the position shown in FIG. 4 that permits fluid flow to the vial.

In this manner, in this position, the solution temporarily stored in bag 18 (that had been mixed with the contents of the first vial) may be mixed and shaken together with the contents of the second vial to form a solution, which again may be stored temporarily in bag 18 (the second vial being now empty). Accordingly, the vial adapter modular assembly 10 can be used to serially mix different substances in a drug mixing system in a "daisy chain" of vials, one after the other. When the solution is finally mixed and ready for administration to a patient, an infusion set (not shown) may be connected to the exit port of the last vial adapter modular assembly.

Figure 6:
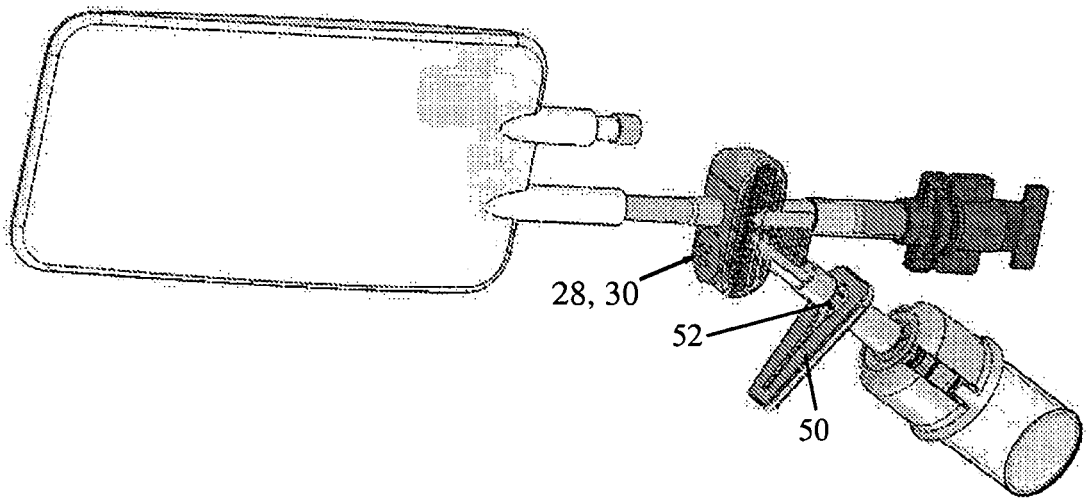
FIG. 6 is a pictorial illustration of a vial adapter modular assembly for a drug mixing system, constructed and operative in accordance with another embodiment of the present invention, including a closure element with a clamp that selectively closes and opens a flow conduit that leads to the vial port.

Reference is now made to FIG. 6, which illustrates a vial adapter modular assembly for a drug mixing system, constructed and operative in accordance with another embodiment of the present invention. The assembly is the same as assembly 10, except that instead of a plunger, there is a closure element 50 with a clamp that selectively closes and opens a flow conduit 52 that leads to the vial port 20.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A vial adapter modular assembly comprising:

a bag spike port connectable to an output port of a bag;

a vial port connectable to a vial;

an exit port;

a lumen having a vial port flow opening in fluid communication with said vial port; and a closure element configured for linearly sliding in said lumen between a non-blocking position and a blocking position, wherein in the non-blocking position, said closure element does not block said vial port flow opening and permits fluid flow between said bag spike port and said vial port, and wherein in the blocking position, said closure element blocks said vial port flow opening and blocks fluid flow between said bag spike port and said vial port;

wherein said closure element moves linearly along said lumen to the blocking position upon insertion of the exit port into a bag spike port of a second vial adapter modular assembly.

2. The vial adapter modular assembly according to claim 1, further comprising a vent element, wherein said lumen has a vent port flow opening in fluid communication with said vent element, and wherein in the non-blocking position, said closure element does not block said vent port flow opening and permits fluid flow between said bag spike port and said vent element, and wherein in the blocking position, said closure element blocks said vent port flow opening and blocks fluid flow between said bag spike port and said vent element.

3. The vial adapter modular assembly according to claim 1, wherein said closure element is formed with a hollow portion and apertures are formed at a distal end of said closure element, wherein fluid is flowable through said hollow portion and said apertures.

4. The vial adapter modular assembly according to claim 2, wherein said vent element comprises a filter.

5. The vial adapter modular assembly according to claim 2, wherein said vent element is positioned along said lumen at a junction of said bag spike port, said vial port and said exit port.

6. The vial adapter modular assembly according to claim 2, wherein said vent element is positioned at at least one of said bag spike port, a cap, said vial port and said exit port.

7. The vial adapter modular assembly according to claim 1, further comprising a cap for closing said exit port.

* * * * *